United States Patent [19]

Ford

[11] 4,037,661

[45] July 26, 1977

[54] METHOD AND APPARATUS FOR CLEANING A SCREENED WELL

[75] Inventor: George Alan Ford, Houston, Tex.

[73] Assignee: Walker-Neer Manufacturing Co., Inc., Wichita Falls, Tex.

[21] Appl. No.: 697,404

[22] Filed: June 18, 1976

[51] Int. Cl.[2] ..... E21B 37/00; E21B 43/25

[52] U.S. Cl. ..... 166/311; 166/223

[58] Field of Search ..... 166/311, 312, 157, 222, 166/223, 242; 175/320, 321, 314

[56] References Cited

U.S. PATENT DOCUMENTS

| | | | |
|---|---|---|---|
| 1,484,601 | 2/1924 | Carmichael | 166/312 |
| 1,558,796 | 10/1925 | Dunn | 166/312 |
| 1,774,640 | 9/1930 | Dunn | 166/312 |
| 2,362,403 | 11/1944 | Reynolds | 166/312 X |
| 2,687,774 | 8/1954 | Hodges | 166/312 |
| 3,547,191 | 12/1970 | Malott | 166/223 |
| 3,760,878 | 9/1973 | Peevey | 166/311 X |

*Primary Examiner*—Stephen J. Novosad
*Attorney, Agent, or Firm*—Hume, Clement, Brink, Willian & Olds, Ltd.

[57] ABSTRACT

A system for developing or cleaning a screened well using dual concentric drill pipe. A blind annulus injection sub and a development head are interconnected with the drill pipe and so constructed that compressed air passing down the inner pipe is directed through nozzles in the head to agitate formation water and clear the screen. When air is passed down the pipe annulus it is injected into the inner pipe and causes formation water and sand to be drawn into the head and airlifted to the surface through the inner pipe.

11 Claims, 5 Drawing Figures

METHOD AND APPARATUS FOR CLEANING A SCREENED WELL

BACKGROUND OF THE INVENTION

Dual concentric drill pipe systems are particularly useful for drilling situations wherein the conservation of drilling fluid (e.g., mud or water) is important. A system for reverse circulation dual tube drilling is disclosed in Henderson U.S. Pat. No. 3,208,539.

In conventional circulation, single tube drilling systems, drilling fluid is pumped down the drill pipe to the bit, and returns to the surface in the annular space between the drill pipe and the hole wall (the hole annulus). In reverse circulation dual tube system the drilling fluid is pumped down the annular space between the inner and outer tubes (the pipe annulus) and returns to the surface through the inner tube. Thus, loss of drilling fluid is minimized. Reverse circulation dual tube drilling is a particularly valuable technique in connection with the drilling of water wells, especially in remote or arid regions, where water or other drilling fluid is difficult or expensive to obtain.

The development and cleaning of screened water wells is a significant aspect of water well technology. Prior art systems and techniques for the development of water wells are described in a publication of the United States Army dated August, 1957, "WELLS" (Department of the Army Technical Manual TM5-297). These techniques include surging with plungers, open and closed-well methods using compressed air, backwashing, and the like. A common element of the prior art methods involves agitation of the formation water in the vicinity of the well screen so as to clean the screen and surrounding gravel of small particles and draw those particles into the well. The particles and dirty water are then removed from the well, either by conventional bailing, or by airlift using an airline and drop pipe.

Such prior art techniques suffer several deficiencies. It is usually not possible to employ the drill pipe which was used to drill the well as part of the development system; separate airlines and eductor pipes are required. In addition, in compressed air systems, compressor requirements are often too high, and development proceeds at an inefficient rate.

SUMMARY OF INVENTION

It has been discovered that an extremely efficient well development system can be designed utilizing dual concentric drill pipe. The present invention contemplates one or more tools which are specially designed and adapted to be used at the end of a string of dual tube drill pipe for development of a screened well once the drilling operation has been completed.

Upon completion of the drilling operation, the well screen is set, typically in conjunction with the well casing. At this point, the bit which was used to drill the well is removed and the specially designed tools of the present invention are placed at the end of the drill string. These include a blind annulus injection sub with a means for blocking the downward flow of compressed air in the pipe annulus of the dual tube string and injecting that air into the inner tube of the string, and a development head adapted to be interconnected in fluid communication with the inner tube of the string. The development head includes one or more orifices or nozzles for directing jets of compressed air into the well, toward the screen, to agitate the formation water and clear the screen and surrounding gravel. The head may also include an orifice through which dirty water and associated sand and other particles may be drawn for pumping to the surface through the inner tube by airlift.

The dual tube drill string, with tools attached at the bottom end, is placed in the well, so that the development head is aligned with the well screen. Compressed air is then directed downwardly through the inner tube into the head and out the head nozzles to agitate the well water and cause the smaller particles to be disassociated from the larger particles of gravel surrounding the screen. During this operation, the drill string may be rotated, and may also be moved axially in the hole so that the nozzles traverse the entire inner area of the screen. The source of compressed air is then switched to the pipe annulus so that the air proceeds down-hole in the pipe annulus until it reaches the blind end of the annulus, where it is diverted and injected into the inner tube. This diversion and injection results in a very efficient airlift pumping action which draws well water and associated particles into the head and upward through the inner tube to the surface.

The general object of the present invention is to provide a system for the development or cleaning of screened wells which is particularly adapted for use with dual tube drill pipe, with increased efficiency and economy. Other objects of the invention will become apparent upon consideration of the following description, with references to the appended drawings in which.

DESCRIPTION

Figure 1:
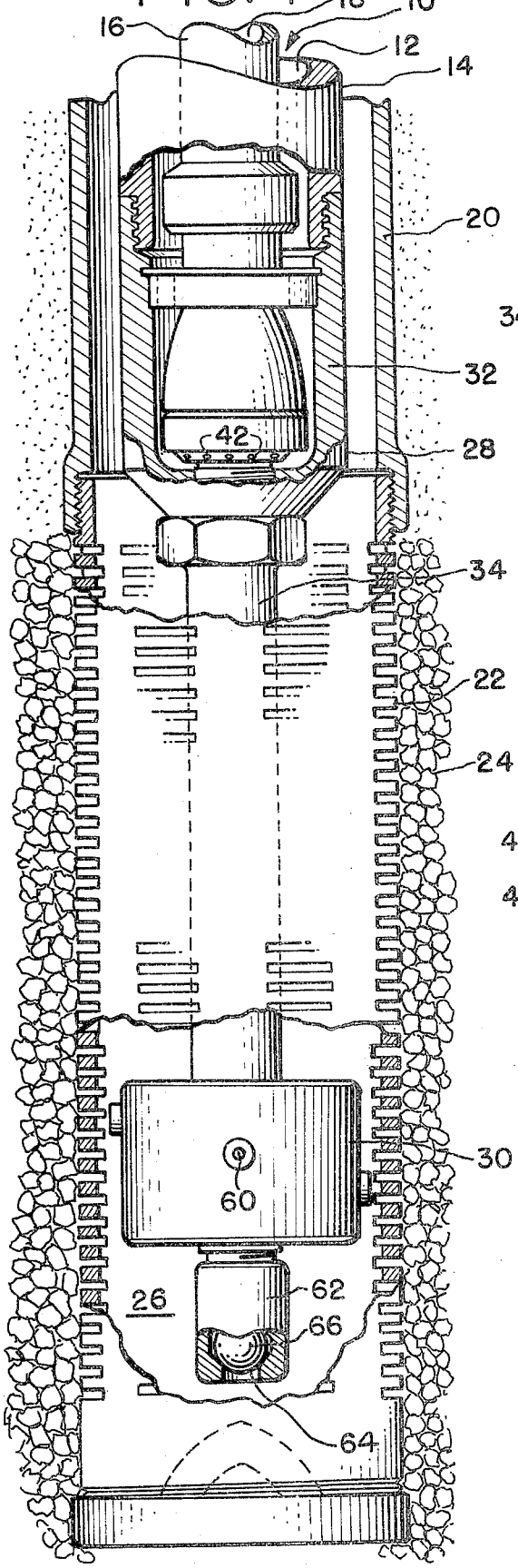
FIG. 1 is a transverse sectional view of a screened well showing a system of apparatus embodying the present invention.
Figure 3:
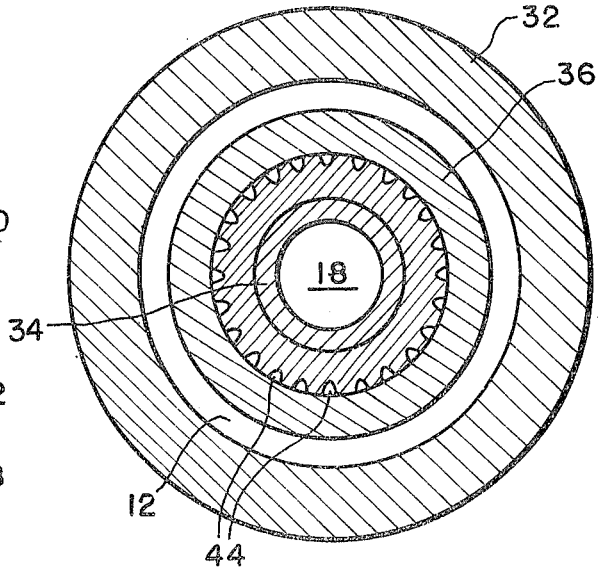
FIG. 3 is a cross sectional view taken on the line 3—3 of FIG. 2.
Figure 4:
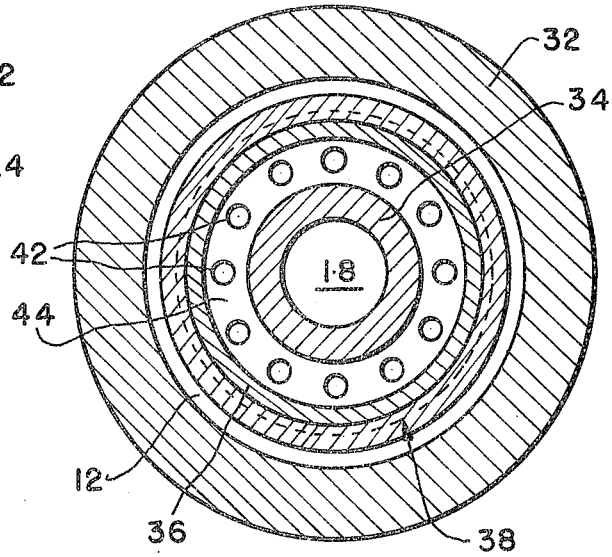
FIG. 4 is a cross sectional view taken on the line 4—4 of FIG. 2.
Figure 5:
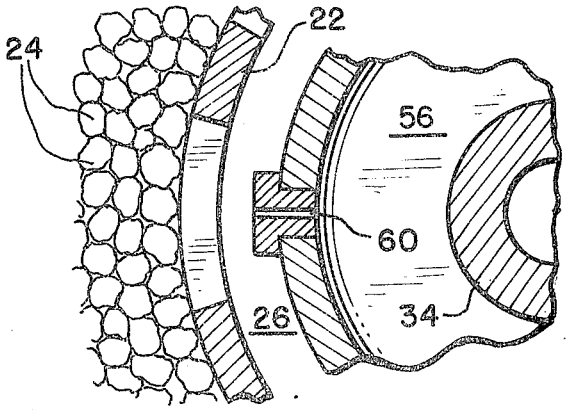
FIG. 5 is a cross sectional view taken on the line 5—5 of FIG. 2.

With reference to the drawings, there is shown in FIG. 1, as an example of one form in which the present invention may be embodied, a well development system for use with a string of dual concentric drill pipe generally designated by the numeral 10. Only the very lowermost portion of one segment of the drill string 10 is shown, and it is to be understood that the drill string 10 extends to the surface where it is associated with the necessary components of a drilling system, such as a rotary drilling rig, and a source of drilling fluid.

In drilling a well, the drill spring 10, with a suitable bit attached at its lower end, is rotated and drilling fluid is pumped down-hole in the annular passageway 12 defined between the outer pipe 14 and the inner pipe 16. The drilling fluid passes through the pipe annulus 12 to the vicinity of the bit, assisting in the cutting process, and then returns to the surface through the inner passageway 18 within the inner tube 16, carrying with it cuttings and debris from the hole bottom.

Upon completion of the well drilling operation, a casing 20 is usually set in the well, together with a well screen 22. The well screen 22 may be of any suitable type having slots or openings which are sized to exclude coarser sand or gravel 24 in the surrounding formation from the interior of the well 26. The smaller particles of sand or gravel are able to pass through the slots and into the well bore 26.

When it is desired to develop a newly drilled well (or clean an old well) the bit is removed from the dual tube drill string 10 and is replaced with an injection sub 28 and development head 30. These two tools, 28 and 30, in association with the dual tube drill string 10 and a source of compressed air (not shown) comprise a system for the development or cleaning of screened wells.

Figure 2:
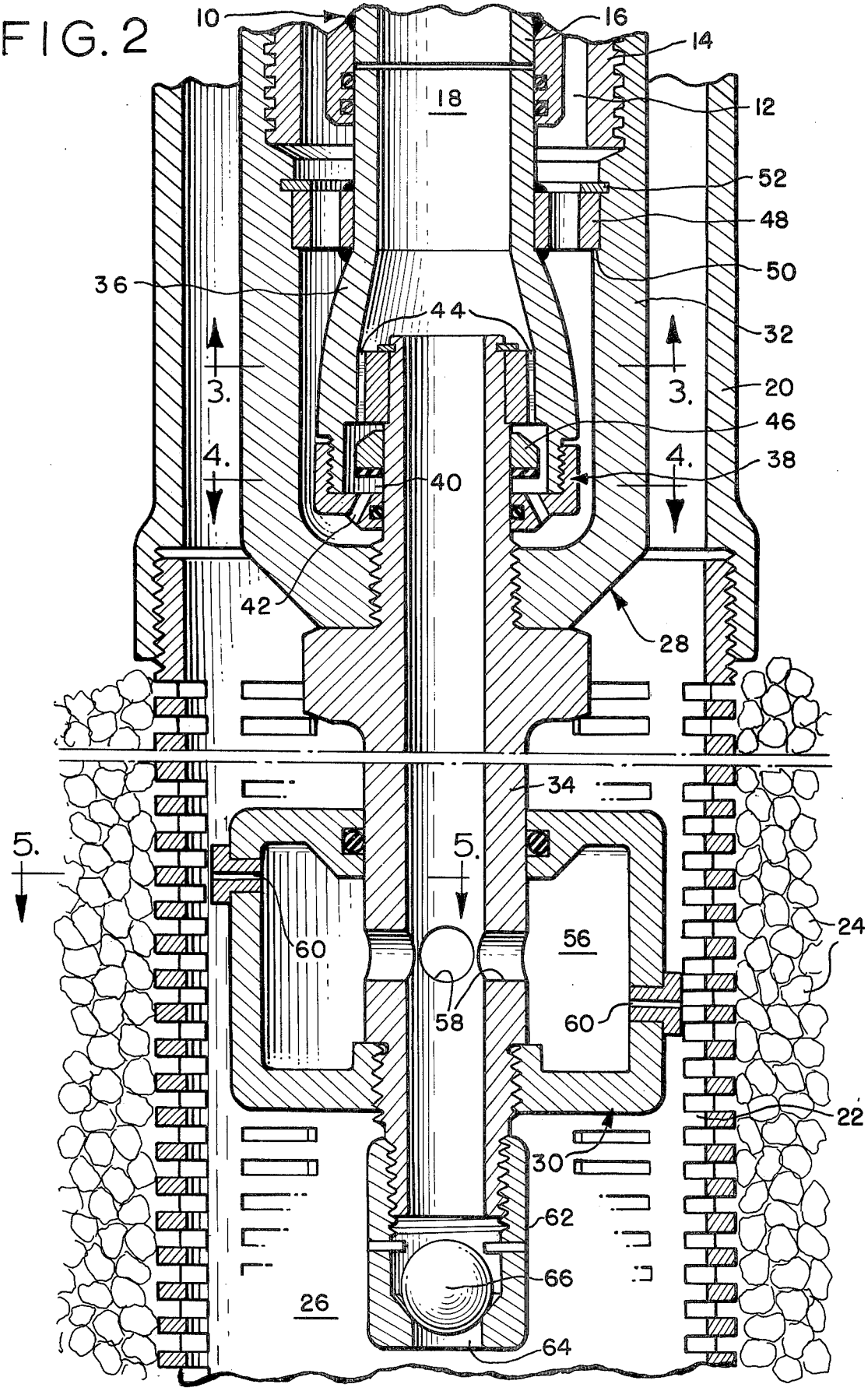
FIG. 2 is an enlarged transverse sectional view of the well development tools shown in FIG. 1.

As best shown in FIG. 2, the injection sub 28 includes an outer tubular member 32 which is adapted for interconnection with the lower end of the outer tube 14 of the drill string 10. The outer tubular member 32 is adapted at its lower end to connect with a pipe or tube 34 which provides a fluid flow passage to the head 30, in fluid communication with the central flow passage 18 defined by the inner tube 16 of the drill string 10. The outer tubular member 32 is of blind annulus construction, so as to terminate or block the annular flow passage 12 defined between the inner and outer tubes 16 and 14 of the drill string 10.

The injection sub 28 also includes an inner tubular member 36 and means, generally designated by the numeral 38, for diverting fluid flow from the annular passage 12 into the central passage 18. The means 38 may include a chamber 40 which is in fluid communication with the pipe annulus 12 through ports 42. The chamber 40 is similarly in fluid communication with the central passage 18 by means of a second set of ports or apertures 44. An annular sliding valve 46 serves to permit the passage of fluid from the annular passage 12 ultimately into the central passage 18, but prevents the passage of fluid or dirt in the opposite direction. A suitable form of injection sub is disclosed in my copending U.S. pat. application Ser. No. 621,655 filed Oct. 14, 1975, now U.S. Pat. No. 3,978,923.

The inner tubular member 36 is suspended within the outer tubular member 32 by means of a ring 48 which bears against a shoulder 50 on the interior of the tubular member 32. A snap ring 52 serves to hold the ring 48 in place. The ring 48 includes a series of holes or apertures 54 which ensure a continuation of the annular flow passage 12.

The head 30 defines an interior chamber 56 which is in fluid communication with the central passage 18, through the pipe 34, by means of a series of ports or apertures 58. Spaced about the exterior of the head 32 are one or more nozzles 60 which constitute exit orifices providing fluid communication between the chamber 56 and the well bore 26. The pipe 34 continues through the interior of the head 32 and out the bottom thereof where it terminates in an intake unit 62. The intake unit 62 includes an orifice 64 which is normally closed by a ball valve 66. Thus, when the valve 66 is opened, there is fluid communication between the well bore 26 and the central passage 18 through the pipe 34.

It should be understood that numerous changes may be made in the apparatus specifically illustrated in the drawings without departing from the scope and spirit of the invention. For example, the injection sub 28 and development head 30 could be made as an integral unit or, alternatively, could be constructed from numerous individual components. Moreover, the interconnection of the components, the means for sealing, valving, suspension and the like can be varied without departing from the invention. The principle requisites of the development system of the present invention are means for blocking the pipe annulus 12 and diverting air flow from the pipe annulus into the central passage 18, means for directing air from the central passage 18 toward the vicinity of the screen 22, and means for directing formation water and associated sand from the well bore 26 into the central passage 18.

The operation of the well development system of the present invention may now be described. After the well is drilled and the casing 20 and screen 22 are set, the bit is removed from the dual pipe string 10 and the sub 28 and head 30 are attached to the lowermost segment of the drill string. The drill string 10 is then inserted into the well until the head 30 is in axial registry with the screen 22. At this point, a source of compressed air is connected to the inner tube 16 and compressed air is pumped down the central passage 18. The annular valve 46 in the chamber 40 prevents air from passing into the pipe annulus 12, so that the air is forced to flow through the pipe 34 into the head 30. Similarly, the valve 66 closes the intake orifice 64 and all of the air passing downwardly through the central passage 18 enters the head chamber 56 through the ports 58. From the chamber 56, the compressed air is forcefully directed through the nozzles 60 toward the screen 22. This causes agitation of the formation water in the well bore 26 and a consequent outward flow or surge through the screen 22 into the surrounding gravel 24. The compressed air exiting through the nozzles 60 also assists in clearing the screen 22. During this step, the dual tube drill string 10 may be rotated so that the nozzles traverse the entire interior circumference of the screen 22. Similarly, the drill string 10 may be raised and lowered so that the nozzles 60 axially traverse the entire length of the screen 22.

Next, the source of compressed air is disconnected from the inner tube 16 and connected in association with the outer tube 14 so that the compressed air is directed down the pipe annulus 12. The air enters the chamber 40 through the ports 42 and is diffused or injected into the central passage 18 through the orifice 44. This results in a strong airlift effect, which causes the ball valve 66 to open so that formation water and associated sand and other particles are drawn into the pipe 34 through the intake orifice 64. The airlift pumping causes water to flow from the surrounding gravel formation 24 through the screen 22 in the reverse direction from that of the previous step. Thus, the water and sand within the well bore 26 are effectively airlifted to the surface through the central passage 18.

Alternate repetition of the foregoing steps results in a very effective and efficient surging of the well and a consequent hydraulic development of the surrounding formation. It should be apparent that the same steps can be used very effectively to clean an old well.

I claim,

1. A method for developing or cleaning a screened well employing a system of apparatus including a source of compressed air, a string of dual concentric drill pipe defining first and second fluid flow conduits, means for injecting air from said second conduit into said first conduit and a head adapted for fluid communication with said first conduit and including an entrance orifice for admitting formation liquid from said well and an exit orifice for directing compressed air toward said screen, said method comprising the steps of:

a. connecting said source to said first conduit;

b. directing compressed air through said first conduit, into said head and out said exit orifice to agitate said liquid and clear said screen;

c. disconnecting said source from said first conduit and connecting said source to said second conduit; and d. injecting air from said second conduit into said first conduit at a point above said head, to draw said liquid into said head through said entrance orifice and to pump said liquid together with any solids present to the surface through said first conduit by air-lift.

2. The method of claim 1 wherein said first conduit is the inner tube of said string and said second conduit is the annular space defined between the inner and outer tubes of said string.

3. The method of claim 1 including the additional step of rotating said head during step (b).

4. The method of claim 1 including the additional step of moving said head axially in said well coextensively with said screen during step (b).

5. A system for developing or cleaning a screened well comprising:

a string of dual tube drill pipe including concentrically disposed inner and outer tubes defining first and second isolated continuous fluid flow passages;

a source of compressed gas;

means for alternately connecting said source to said first and second passages;

means at the down-hole end of said string for blocking said second passage and diverting the flow of gas from said second passage to said first passage; and a head adapted for fluid communication with said first passage and including one or more orifices for directing gas from saaid first passage into the bore of said well.

6. The system of claim 5 wherein said orifices are arranged to direct gas toward said screen.

7. The system of claim 5 wherein said head includes a valved orifice adapted to permit liquid from said well to enter said head and flow upwardly in said first passage when said source is connected to said second passage.

8. Apparatus for developing or cleaning a screened well comprising:

an injection sub including an outer tubular member adapted at one end for engagement with an end of the outer pipe of a dual concentric drill pipe string; an inner tubular member adapted at one end for engagement with an end of the inner pipe of said string, said inner and outer members defining an annular fluid flow passage therebetween; and means for blocking said annular passage and diverting fluid flow from said passage into said inner tubular member; and a head adapted for engagement with said sub in fluid communication with said inner member, said head including an orifice for directing fluid from said inner member toward said screen.

9. Apparatus in accordance with claim 8, wherein said sub includes means for preventing fluid flow from said inner tube into said passage.

10. Apparatus in accordance with claim 8, wherein said head includes a valved orifice responsive to a pressure difference between said well and the interior of said head to admit fluid from said well into said head.

11. A tool for developing or cleaning a screened well in conjunction with a string of dual drill pipe having concentrically disposed inner and outer pipes defining continuous annular and central flow passages, said tool comprising:

an inner tubular member adapted for fluid interconnection with the central flow passage of said string;

a head attached to said inner member and including means to direct fluid from said central passage toward the screen of said well;

an outer tubular member adapted for fluid interconnection with the annular flow passage of said string; and means for diverting fluid flow from said annular flow passage into said central flow passage.

* * * * *